United States Patent [19]

Grottrup et al.

[11] 3,946,869

[45] Mar. 30, 1976

[54] TRANSPARENT PACKAGE

[75] Inventors: Helmut Grottrup; Joachim Hoppe; Yahya Haghiri, all of Munich, Germany

[73] Assignee: G.A.O. Gesellschaft fur Automation und Organisation m.b.H., Germany

[22] Filed: July 19, 1973

[21] Appl. No.: 380,616

[30] Foreign Application Priority Data

July 26, 1972 Austria ..... 6424/72

[52] U.S. Cl. ..... 206/466; 141/314; 206/343

[51] Int. Cl.[2] ..... B65D 73/00

[58] Field of Search ..... 206/466, 330, 343, 344, 206/461–471; 141/10, 114, 314, 165

[56] References Cited

UNITED STATES PATENTS

| | | | |
|---|---|---|---|
| 2,745,545 | 5/1956 | Dunning | 206/466 |
| 2,841,282 | 7/1958 | Fuente | 206/466 |
| 3,048,268 | 8/1962 | Rocchi et al. | 206/330 |
| 3,458,037 | 7/1969 | Larson | 206/466 |

FOREIGN PATENTS OR APPLICATIONS

| | | | |
|---|---|---|---|
| 126,358 | 9/1945 | Australia | 206/466 |

*Primary Examiner*—William Price
*Assistant Examiner*—Douglas B. Farrow
*Attorney, Agent, or Firm*—McGlew and Tuttle

[57] ABSTRACT

A package comprises a relatively stiff rectangular backing board with a transparent substantially rectangular bag of a smaller size secured to the backing board along a small marginal area adjacent its top edge. The backing board advantageously includes a fold down top edge or collar which engages over an upwardly extending portion of the underside of the bag and the bottom edge of the collar is spaced from the opening edge on the top side of the bag and the bag may be torn off the backing board by tearing it along the lower edge of the collar. The backing board advantageously includes one or more recesses which are engageable by a driver member to move the package assembly. The package is advantageously formed by feeding a continuous roll of plastic which has been creased along a central fold line into association with means for separating the two layers to insert materials therein and for then sealing the separated layers at spaced locations along the length of the material and for also sealing the bag adjacent its folded edge to an underlying cardboard to form the completed package.

7 Claims, 10 Drawing Figures

TRANSPARENT PACKAGE

DESCRIPTION OF THE PRIOR ART

The present invention relates to a transparent package, particularly for flat articles such as banknotes. Such packages are used, for example, by financial institutions in order that prepared amounts of money are available at the counters to permit quicker serving of the customers. However, these packages are not suitable for mechanical transport, i.e. particularly not for use in automatic dispensing machines because they cannot be readily pulled off the stack. It is known to place flat articles on cardboard and effect the packaging by sealing the articles on the cardboard with a shrink film; such a package can be mechanically transported if suitable measures are taken, but the packaged articles can no longer be seen from both sides.

SUMMARY OF THE INVENTION

The invention is aimed at providing a remedy for this by proposing a transparent package for flat articles which can be stacked and pulled off the stack, it still being possible to see the package articles from both sides. The package is to be simple and is to serve as a tear-open/disposable package. The invention therefore relates to a transparent package for flat articles, such as banknotes, which is suitable for mechanical transport and/or for being pulled off a stack.

The fundamental idea of the invention is to hinge the enclosed, bag-like package along one edge, in the case of a rectangular size preferably along one short edge, to a card-like substrate covering at least the total area of the bag and having means for mechanical transport. The inventive design of the package permits the bag to be turned upwards, so that the packaged articles can be inspected from both sides.

The card-like substrate may have transport holes which are engaged by corresponding drivers of the transporting or pull-off device. If the transport holes are arranged to be covered by the bag resting flat on the substrate, it is insured that the driving device always takes along only one package whereby always only one package is pulled off the stack, for example.

It may be advantageous to provide at the long sides of the substrate a grooved profile which serves as an aid to transport.

According to a further feature of the invention, the articles are packaged in a vacuum by vacuum-welding that side which is open last; appropriately, that side of the bag is welded last which will be connected with the substrate. Through the packaging in a vacuum, the film of the bag clings tightly to the contours of the contents of the package because the air cushions between the individual flat objects as well as between the packaging film and the packaged articles are drawn off, so that areal adhesion is obtained between the individual layers, the latter thereby being held in position. This type of package also permits the packaged articles to be imbricated without the latter being able to slip out of place after packaging. Through the imbricate arrangement, all parts of the package's contents can be seen.

Advantageously, the bag may be attached to the substrate by providing at the respective end of the substrate a suitably shaped turn-down collar which extends over a portion of the bag and is sealed with the bag. The edge of the turn-down collar may serve as the tear-off edge for the bag. If the weld of the bag is covered by the turn-down collar or is at least flush with the latter's edge, the bag is automatically opened when being torn off. Together with the welding in a vacuum, this automatic opening affords safety from unauthorized manipulation on the bag. If the package could be torn off without being opened, one could open the bag at a suitable point, take out a banknote, for example, and weld it up again, then making a claim with the bank concerning the wrong contents.

In the case of the novel bag, however, re-welding would be possible at the short side only; this would be very difficult and could only be done with a special tool. This will deter a forger from manipulations, the more so since the subsequently produced weld is perceptible, too.

Accordingly, it is an object of the invention to provide a package which comprises a relatively stiff substantially rectangular backing board with a transparent substantially rectangular bag of a smaller size than the backing board mounted on the board and secured thereto along a marginal area adjacent one edge and wherein the backing board advantageously includes a foldable collar adjacent its edge which is foldable downwardly over the secured portion of the bag and it advantageously includes means permitting engagement thereof by a driver to move the bag.

A further object of the invention is to provide a transparent package which is simple in design, rugged in construction and economical to manufacture.

For an understanding of the principles of the invention, reference is made to the following description of typical embodiments thereof as illustrated in the accompanying drawings.

GENERAL DESCRIPTION OF THE PREFERRED EMBODIMENTS

Figure 1:
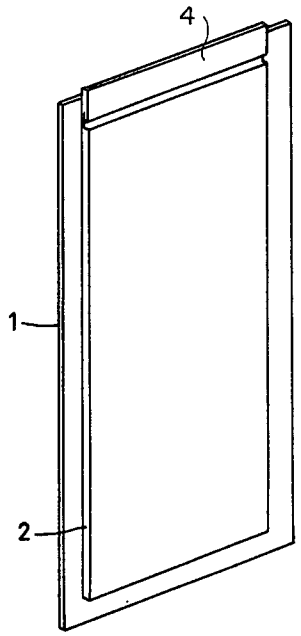
FIG. 1 is a front or top perspective view of a package constructed in accordance with the invention.

Referring to the drawings in particular, the invention embodied therein comprises several types of package made in accordance with the invention.

FIG. 1 shows one example of the novel package; the package essentially consists of the actual bag 2 with the piece of cardboard 1. The piece of cardboard is the stabilizing element which permits the mechanical processing, particularly the transport, of the package.

Figure 2:
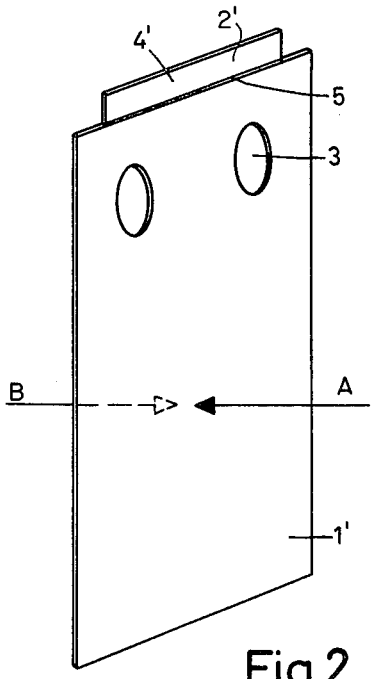
FIG. 2 is a rear perspective view of another embodiment of the invention.
Figure 3:
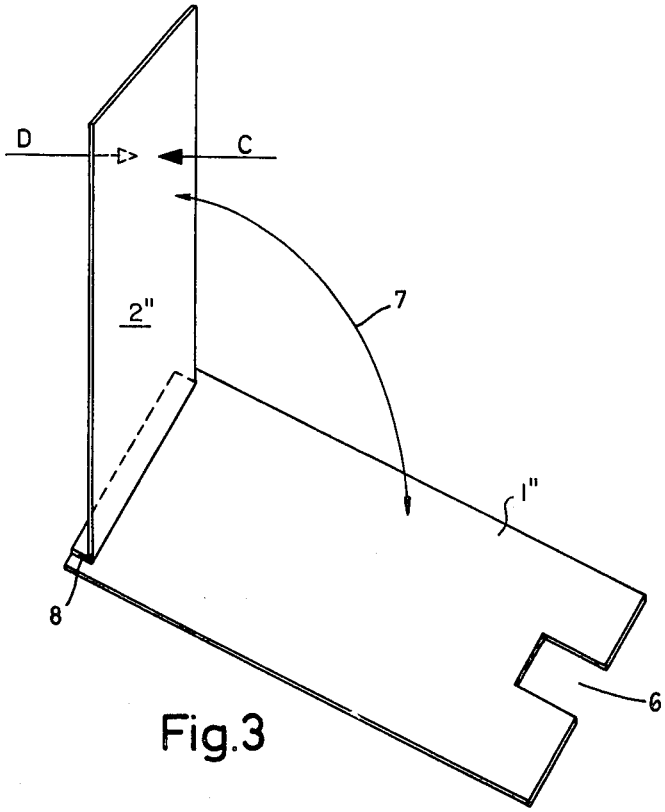
FIG. 3 is a top perspective view indicating the manner in which the bag may be lifted from the backing board of another embodiment of the invention.

FIG. 2 shows that the cardboard 1 is card-like in shape and has transport holes 3. The turn-down collar 4, which is connected to the cardboard via the flute 5, serves to attach the bag 2 as will be explained below. The two sides A and B of the piece of cardboard 1 may be provided with imprints because the bag 2 is connected with the cardboard 1 at one side only and thus can be turned upwards as can be seen from FIG. 3. FIG. 3 also shows how the bag 2 is sealed with the cardboard 1 at its short side 8 after the turn-down collar 4 has been turned down.

The hinge obtained in this way permits the packaged articles to be inspected from both sides C and D after the bag has been turned upwards (arrow 7).

Figure 4:
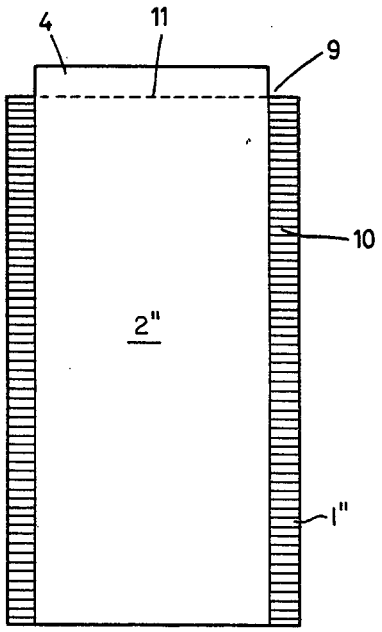
FIG. 4 is a plan view of still another embodiment of the invention.

In the example of FIG. 3, the transport holes 3 and 6 of the other embodiments have been replaced by a transport recess 6, while in the example of FIG. 4, grooved rims 10 on the cardboard 1' are provided as transport means. The perforation 11 facilitates the turning-down of the turn-down collar 4, which is narrower than the piece of cardboard by the recess 9 in order that the grooved rims are not covered when the turn-down cover is turned down.

Figure 5:
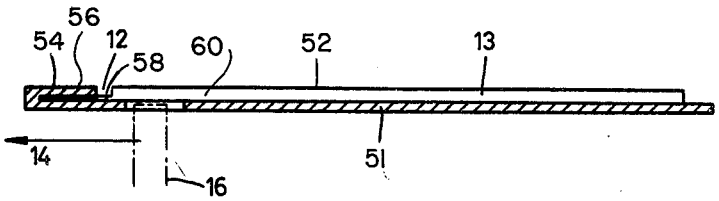
FIG. 5 is a longitudinal sectional view of still another embodiment of the invention.

FIG. 5 shows a cross section of the package similar to FIGS. 1 and 2. It can be seen that the bag 52 is connected with the cardboard 51 by means of a turn-down collar 54 and that there is an interspace 12 between the tear-off edge 46 of the turn-down collar 54 and the open edge 58 to permit the tear-off of the bag 20 with the contents 13 of the bag. This insures that the contents of the bag are not damaged when the bag 2 is torn off the cardboard 1.

Figure 6:
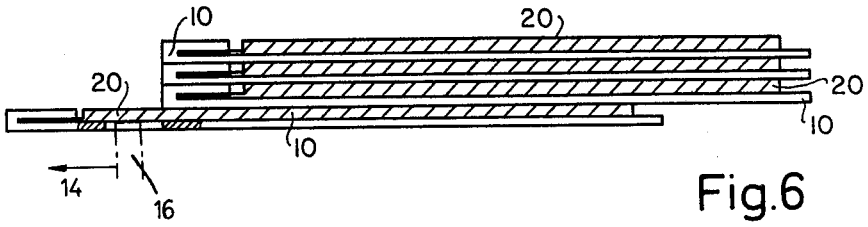
FIG. 6 is a longitudinal sectional view of the embodiment of the invention shown in FIG. 5 indicating the manner in which the packages may be stacked and transported away from the stacking.

In the position shown in FIG. 5, several packages may be piled up (FIG. 6) and pulled off in the direction of arrow 14. To accomplish this, a driver 16 of a suitable transporting device enters the interspace formed by the transport holes 60. The interspace is limited above by the bag 52, so that the driver 16 cannot reach a second package; this permits reliable pull-off, the more so since the bag 52 remains fixed on the cardboard during this movement.

Figure 7:
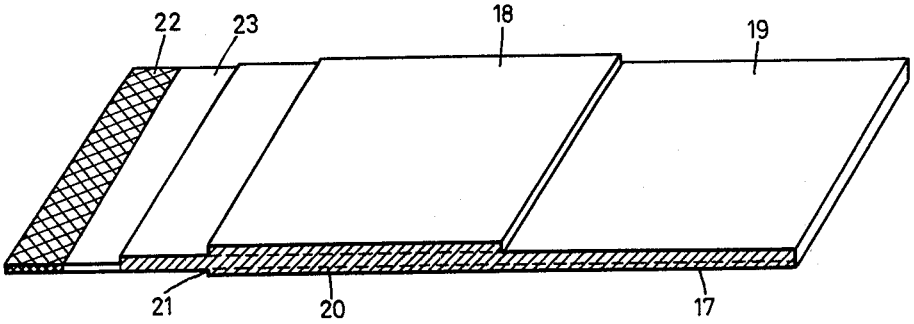
FIG. 7 and FIG. 8 are perspective views, partly in section, indicating the detailed construction of the bags and the vacuum effect of the overall package.
Figure 10:
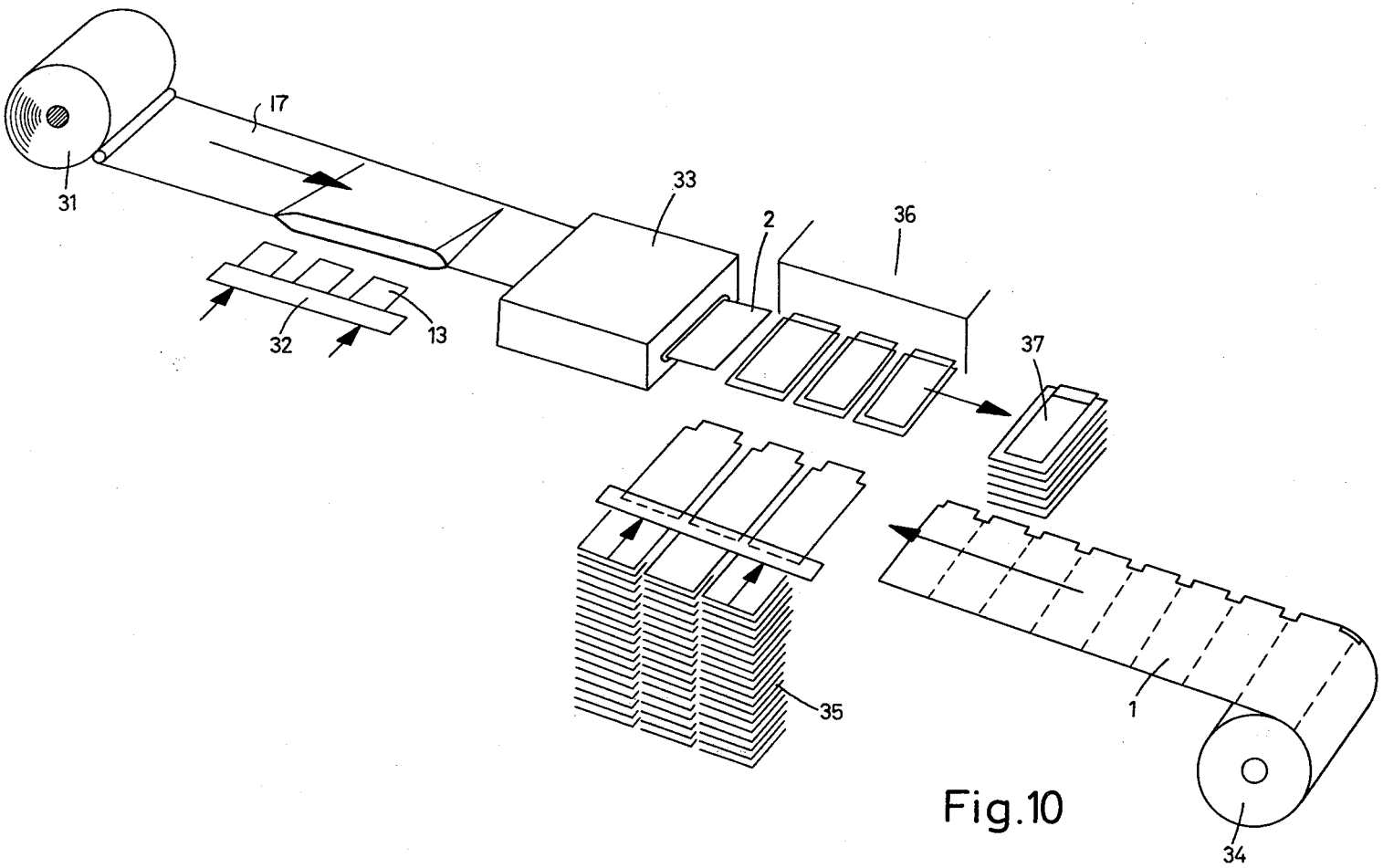
FIG. 10 is a schematic perspective view of a device for making, packing and sealing the package of the invention.

FIG. 7 is to illustrate that the contents of the bag are held in position as a result of the vacuum-packing technique. The bag is made from the transparent plastic film 17, which may be filled either as a bag having one open side or, as shown in FIG. 10, as a half-hose. It is assumed that the articles to be packaged are the three flat objects 18–20 of different size. Through the packaging in a vacuum, the film 17 clings positively to the contents of the package, this being indicated at 21. As a result, the packaged articles are fixed in the bag. The positive connection 21 also affords safety against any unauthorized opening of the bag. Located between the weld 22 and the packaged articles is the selaed area 23.

Figure 8:
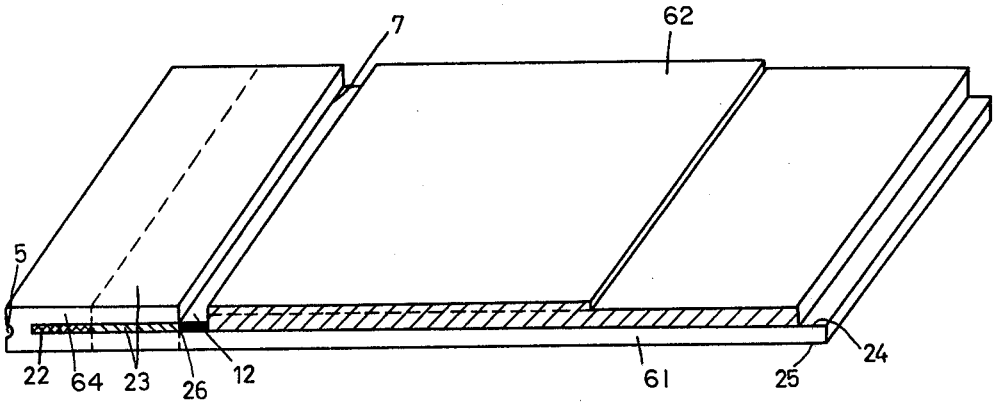

FIG. 8 shows the sealing between the cardboard 61 and the bag 62 in the sealed area 23. The cardboard 61 has a side 24 coated with the material of the film bag 17 as well as an uncoated side 25. The bag 2 lies on the coated side 24 and is partially enclosed by the turned-down turn-down collar 64. The limit 26 of the sealed area 23 lies flush under the cardboard edge 27 of the turn-down collar 64. Between the cardboard edge 27 and the packaged articles 13 there is an interspace 12 within which the bag 2 can be torn off the cardboard 61 for being opened.

Figure 9:
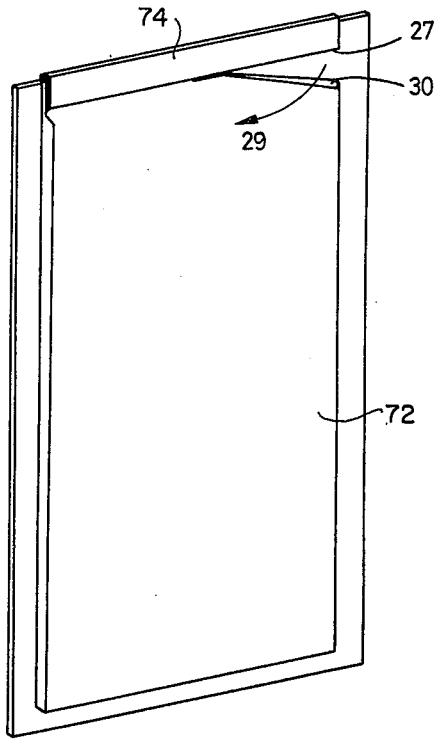
FIG. 9 is a top perspective view of another embodiment of the invention.

FIG. 9 shows the tearing-off operation in the direction of tearing 29. The bag 72 is torn off along the cardboard edge 27, with the latter serving as the tear-off edge. In addition to this feature, which facilitates the tearing-off, the film bag 72 is weakened at the limit of the sealed area 23 through the sealing operation. Since, however, the tear-off line lies outside the sealed area and within the interspace 12, the bag 2, when being torn off, is also automatically opened as indicated at 30. The turned-down turn-down collar 74 stabilizes the sealed area, so that it is insured that not the entire, and thus still closed, bag 72 can be torn off the cardboard 1, but that the bag 2 is always torn open. Furthermore, the enclosure of the film bag 72 by the turn-down collar 74 and the consequently double sealing in the sealed area 23 afford safety against any unauthorized opening of the bag 72.

FIG. 10 shows schematically a possibility of manufacturing the package according to the invention, as shown in FIGS. 1 to 9, mechanically. The bags may be made from a so-called half-hose 31, with the latter being spread apart in the region of the filling station 32 so that the articles to be packaged can be filled in automatically. After the filled half-hose has passed through the vacuum-welding station 33, the complete, welded bags are ready for further processing, either joined together with perforation welds or, as shown, separately with parting welds.

The pieces of cardboard 1 may also be fed from the reel 34 or as prefabricated cards from the stack 35 to the sealing station 36, in which the complete package is produced. In the example shown it is assumed that three packages are always manufactured at the same time.

What is claimed is:

1. A package comprising a relatively stiff substantially rectangular board having top, bottom and two side edges with said top and bottom edges being of smaller dimension than said side edges, a transparent substantially rectangular bag of a size smaller than said board having a straight top edge and a top marginal area adjacent said top edge secured on its underside to said board and having an open edge on its top side parallel to and spaced from said top edge, said board having an engagement recess for engagement by a driver to move said package, and a narrow single collar formed in said board along said top edge of said board and spaced inwardly from said side edges and being folded downwardly into abutting engagement with and sealed to said bag between said straight top edge of said bag and said opening edge, said narrow single collar having straight lower edge extending across said bag forming a severing edge along which said bag may be turn.

2. A package, according to claim 1, wherein said engagement recess comprises at least one hole through said board.

3. A package, according to claim 1, wherein said engagement recess comprises a plurality of grooves formed between projections extending along a side edge of said board.

4. A package, according to claim 1, including articles in said bag, said bag being vacuum packed and sealed.

5. A package, according to claim 1, wherein said bag is sealed adjacent its top edge.

6. A package, according to claim 5, wherein said collar tapers inwardly toward the opposite end of said backing board.

7. A package, according to claim 1, wherein said board comprises a cardboard having a plastic coating, said bag being of a plastic material comparable to said coating, said bag being heat-sealed to said coating.

* * * * *